US008811869B2

(12) United States Patent
Yamamoto

(10) Patent No.: US 8,811,869 B2
(45) Date of Patent: Aug. 19, 2014

(54) FUSING APPARATUS AND IMAGE FORMING APPARATUS

(75) Inventor: Koji Yamamoto, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/358,808

(22) Filed: Jan. 26, 2012

(65) Prior Publication Data

US 2012/0213533 A1 Aug. 23, 2012

(30) Foreign Application Priority Data

Feb. 17, 2011 (JP) ..... 2011-031567

(51) Int. Cl.
*G03G 15/20* (2006.01)
*G03G 15/00* (2006.01)

(52) U.S. Cl.
CPC .... *G03G 15/2028* (2013.01); *G03G 2221/1645* (2013.01); *G03G 2215/00548* (2013.01)
USPC ..... 399/323; 399/405

(58) Field of Classification Search
CPC ..... G03G 2215/00573; G03G 15/2028
USPC ..... 399/323, 33, 67, 68, 122, 405
See application file for complete search history.

(56) References Cited

U.S. PATENT DOCUMENTS

| | | | | |
|---|---|---|---|---|
| 5,802,434 | A * | 9/1998 | Takehara et al. | 399/323 |
| 7,440,723 | B2 * | 10/2008 | Uehara et al. | 399/328 |
| 7,817,950 | B2 * | 10/2010 | Burton et al. | 399/323 |
| 2009/0304419 | A1 * | 12/2009 | Roof et al. | 399/323 |

FOREIGN PATENT DOCUMENTS

| | | |
|---|---|---|
| JP | 08-054801 | 2/1996 |
| JP | 2003-118220 | 4/2003 |
| JP | 2007-079411 | 3/2007 |
| JP | 2008-009097 | 1/2008 |

OTHER PUBLICATIONS

Japanese Office Action, Patent Application No. 2011-031567, Dispatch date: Apr. 1, 2014 (total 3 pages).
English language translation of Japanese Office Action, Patent Application No. 2011-031567, Dispatch date: Apr. 1, 2014 (5 pages).

* cited by examiner

*Primary Examiner* — Daniel J Colilla
*Assistant Examiner* — John M Royston
(74) *Attorney, Agent, or Firm* — Lucas & Mercanti, LLP

(57) ABSTRACT

Disclosed is a fusing apparatus including: a fusing section including a nipping section which conveys a recording medium while applying pressure and heat to the recording medium; an injecting section which is provided on a downstream side of a conveying direction of the recording medium with respect to the nipping section and which injects gas between a recording medium conveyed by the nipping section and attached to the fusing section and the fusing section; a detecting section which detects jamming of the recording medium in a conveying path of the recording medium; and a separating section which separates the injecting section from the fusing section when jamming of the recording medium is detected by the detecting section.

14 Claims, 11 Drawing Sheets

FUSING APPARATUS AND IMAGE FORMING APPARATUS

CROSS-REFERENCE TO RELATED APPLICATIONS

This Application claims the priority of Japanese Patent Application No. 2011-031567, filed Feb. 17, 2011, this Application is incorporated herein by reference.

BACKGROUND

1. Field of the Invention

The present invention relates to a fusing apparatus and an image forming apparatus.

2. Description of Related Art

Conventionally, there is an image forming apparatus including a fusing apparatus which fuses an image (for example, toner image) formed on a recording medium (for example, sheet, etc.) to the recording medium. In the fusing apparatus, for example, a nipping section is formed by a belt and a roller in contact with each other, the belt supported by a plurality of rollers and the roller provided to face one of the rollers which supports the belt, and the nipping section nips a sheet and pressure is applied to the sheet. Heat is applied to the belt with a heater, etc., and the fusing apparatus applies pressure and heat simultaneously on the sheet nipped by the nipping section to fuse the image on the sheet.

In the fusing apparatus, fusing processing is performed on the sheet nipped by the nipping section while conveying the sheet with the rotating motion of the rollers and the sheet is ejected to a predetermined conveying path. Here, the ejected sheet may be attached to the outer peripheral surface of the belt which forms the nipping section. In this case, the sheet is not ejected to the predetermined conveying path (ejection failure). In an image of a sheet where such ejection failure occurs, the toner image is overheated, and therefore the image quality is poor, such as unevenness of the toner surface occurring. Moreover, with the sheet attached to the belt, the fusing apparatus cannot favorably perform the fusing processing afterward. Therefore, Japanese Patent Application Laid-Open Publication No. 2007-79411 describes an image forming apparatus which includes an injecting apparatus which injects a gas between the belt and the sheet passed and ejected from the nipping section in order to separate the sheet from the belt.

The pressure applied to the gas injected from the injecting apparatus decreases in the path from when the gas is injected to when the gas enters between the sheet and the belt. In order to favorably separate the sheet from the belt, it is preferable to inject a gas with high pressure between the sheet and the belt. Therefore, in order to keep the reduction of pressure of the injected gas to a minimum, it is preferable that the tip of the injecting opening (for example, nozzle shown in FIG. 10) of the injecting apparatus is close to the belt of the fusing apparatus as much as possible.

However, in a conventional image forming apparatus, when the tip of the nozzle is close to the belt of the fusing apparatus, the sheet may cause damage to the fusing apparatus.

Specifically, when the sheet which passes the nipping section and is ejected is not separated from the belt completely, the edge of the sheet may be caught on the tip of the nozzle. In this case, the sheet which is not separated completely is pushed in a narrow space between the tip of the nozzle and the belt when the belt is operated, and this causes jamming (sheet jamming). Here, the pushed and jammed sheet causes damage to the belt, etc. of the fusing apparatus. Damage to the fusing apparatus causes heavy damage such as cost for exchange of the fusing apparatus, decrease of productivity of the image forming apparatus not being able to perform image forming until the exchange is finished, and the like.

In the above description, an example where the sheet is attached to the belt is described, however, similarly, when the sheet is attached to the roller, the recording medium which is pushed in a narrow space between the tip of the nozzle and the roller and jammed damages the roller.

SUMMARY

The present invention has been made in consideration of the above problems, and it is one of main objects to provide an image forming apparatus in which the damage of the fusing apparatus due to jamming of the recording medium can be prevented.

In order to achieve at least one of the above-described objects, according to an aspect of the present invention, there is provided a fusing apparatus including:

a fusing section including a nipping section which conveys a recording medium while applying pressure and heat to the recording medium;

an injecting section which is provided on a downstream side of a conveying direction of the recording medium with respect to the nipping section and which injects gas between a recording medium conveyed by the nipping section and attached to the fusing section and the fusing section;

a detecting section which detects jamming of the recording medium in a conveying path of the recording medium; and a separating section which separates the injecting section from the fusing section when jamming of the recording medium is detected by the detecting section.

Preferably, in the fusing apparatus, the separating section separates the injecting section from the fusing section when the image forming apparatus is not forming an image on the recording medium.

Preferably, the fusing apparatus further includes:

a supporting member which supports the injecting section to enable movement along a predetermined movement path, wherein the separating section moves the injecting section along the predetermined movement path to separate the injecting section from the fusing section.

Preferably, in the fusing apparatus, the supporting member supports the injecting section to enable rotating motion; and the separating section separates the injecting section from the fusing section by rotating motion of the injecting section.

Preferably, in the fusing apparatus, the supporting member supports the injecting section to enable linear motion; and the separating section separates the injecting section from the fusing section by linear motion of the injecting section.

Preferably, the fusing apparatus further includes:

a maintaining section which maintains the injecting section in a position where gas is injected between a recording medium conveyed by the nipping section and attached to the fusing section and the fusing section; and a releasing section which releases the position of the injecting section maintained by the maintaining section when the detecting section detects jamming of the recording medium, wherein the separating section separates the injecting section from the fusing section when the releasing section releases the position of the injecting section maintained by the maintaining section.

Preferably, in the fusing apparatus, the injecting section includes:

a jet flow generating section which generates a jet flow of a gas; and a nozzle provided on a downstream side of a conveying direction of the recording medium with respect to the nipping section wherein the nozzle injects a jet flow of gas generated by the jet flow generating section between a recording medium conveyed by the nipping section and attached to the fusing section and the fusing section, wherein the separating section separates a portion or the entire nozzle from the fusing section.

BRIEF DESCRIPTION OF THE DRAWINGS

The present invention will become more fully understood from the detailed description given hereinbelow and the appended drawings, and thus are not intended to define the limits of the present invention, and wherein.

DETAILED DESCRIPTION OF PREFERRED EMBODIMENTS

Below, an image forming apparatus 1 of an embodiment of the present invention is described in detail with reference to the drawings. The embodiment is one example of the present invention and is not limited to the above.

First Embodiment

Figure 1:
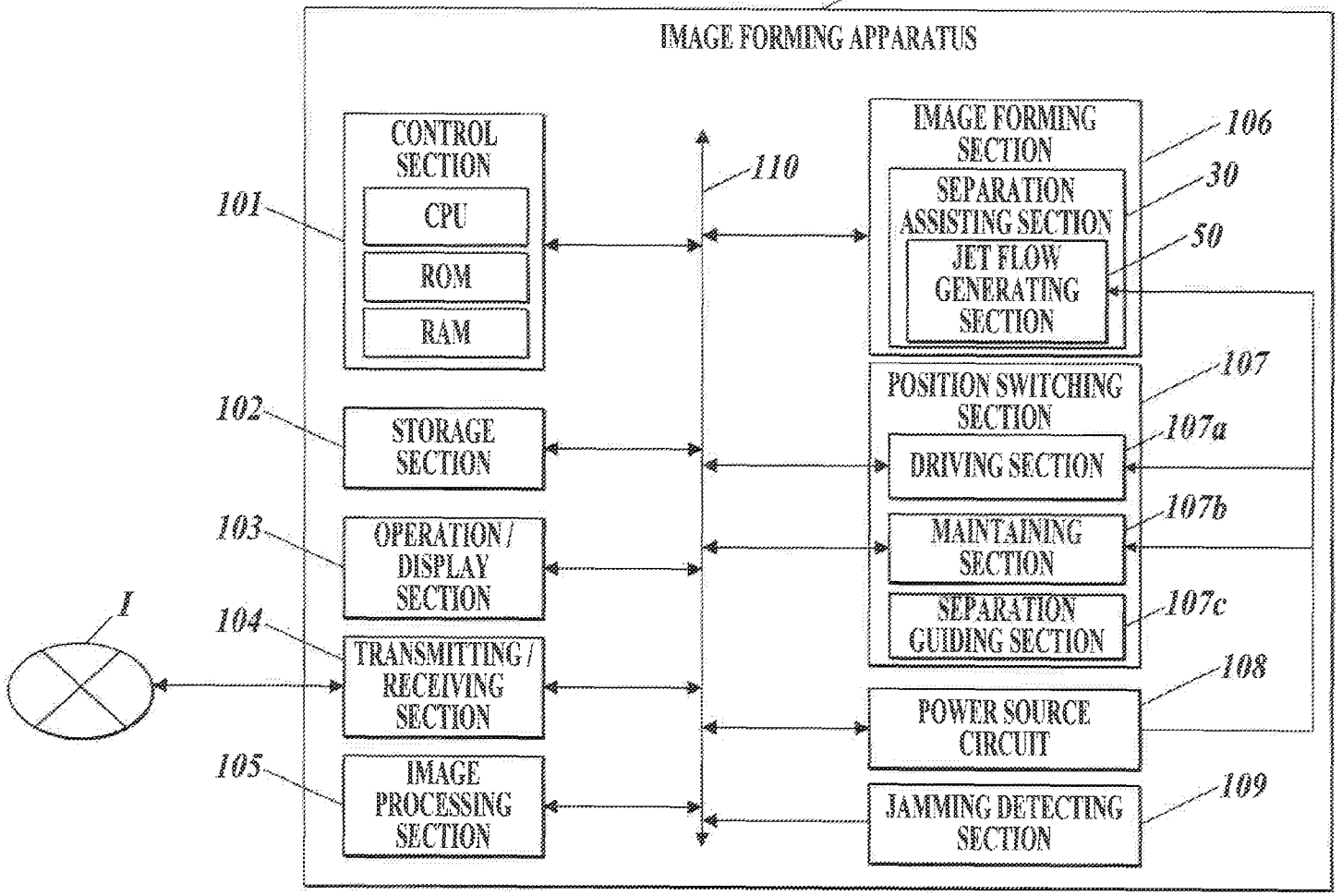
FIG. 1 is a block diagram showing a schematic configuration of an image forming apparatus according to a first embodiment of the present invention.

FIG. 1 is a block diagram showing a schematic configuration of an image forming apparatus 1 of the first embodiment of the present invention.

As described in FIG. 1, the image forming apparatus 1 includes a control section 101, a storage section 102, an operation/display section 103, a transmitting/receiving section 104, an image processing section 105, an image forming section 106, a position switching section 107, a power source circuit 108, a jamming detecting section 109, and the like, and each section is connected to each other by a bus 110.

The control section 101 is composed from a CPU (Central Processing Unit), a ROM (Read Only Memory), a RAM (Random Access Memory), and the like. The CPU of the control section 101 reads out a system program and various processing programs stored in the ROM and expands the programs to the RAM. According to the expanded program, the CPU of the control section 101 centrally controls the operation of each section of the image forming apparatus 1.

The storage section 102 is composed of for example a flash memory, etc. and stores various programs, data, etc. used by each section of the image forming apparatus 1.

The operation/display section 103 includes a display apparatus (not shown) such as an LCD (Liquid Crystal Display), etc. and performs display of various operation buttons, state of the apparatus, operation status of each function, etc. on the display screen based on a display signal output from the control section 101. The display screen of the LCD is covered, by for example, a touch panel (not shown) of a pressure sensitive type (resistive type) configured by placing a transparent electrode in a grid like shape. The touch panel detects XY coordinates of a power point pressed by a finger, a touch pen, etc. with a pressure value and outputs the detected position signal as an operation signal to the control section 101. The operation/display section 103 includes various operation buttons (not shown) such as numeric buttons, start button, etc., and the operation signal by the button operation is output to the control section 101.

The transmitting/receiving section 104 includes, for example a communication circuit, etc. (not shown) and performs control of communication of information with external equipment connected through a communication network I by a predetermined communication standard such as a wired LAN (Local Area Network), wireless LAN, etc. Specifically, the transmitting/receiving section 104 receives image data, etc. transmitted through the communication network I from the external equipment.

The communication network I is a communication network I configured using, for example a dedicated line or using an existing general public line and various line forms such as LAN, WAN (Wide Area Network), etc. can be applied. The communication network I includes, various communication line networks such as a telephone line network, an ISDN (integrated Services Digital Network) line network, a dedicated line, a mobile communication network, a communication satellite network, a CATV line network, etc. and an Internet service provider which connects the above.

The transmitting/receiving section 104 can connect the external equipment with the image forming apparatus 1 through a connection such as a predetermined interface (for example, USB: Universal Serial Bus).

The image processing section 105 performs image processing such as predetermined color conversion processing (for example, YMCK data generating processing) on the image data (for example, image data, etc. received by the transmitting/receiving section 104), γ correction processing of YMCK data, halftone processing and the like, and outputs the image data (print data) on which image processing is performed to the image forming section 106.

The image forming section 106 performs image forming on the recording medium (for example, a sheet, etc.) based on the print data output from the image processing section 105.

The image forming section 106 of the present embodiment is a configuration (tandem type) which transfers each of four colors such as yellow (Y), magenta (M), cyan (C), black (K) using individual electrostatic drums.

Figure 2:
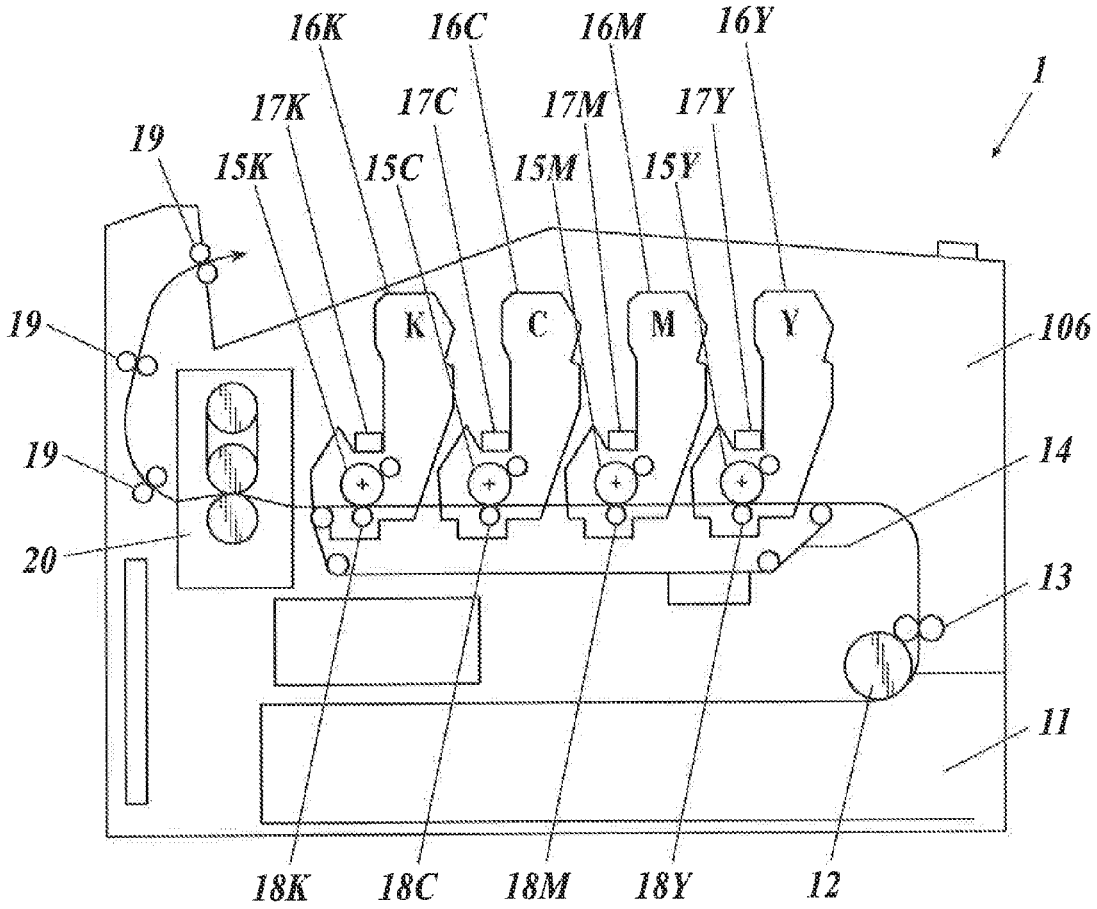
FIG. 2 is a diagram showing a main configuration of an image forming section.

FIG. 2 is a diagram showing a main configuration of an image forming section 106.

As shown in FIG. 2, the image forming section 106 includes a cassette 11, a sheet feeding roller 12, a conveying roller 13, a conveying belt 14, electrostatic drums 15Y, 15M, 15C and 15K, print units 16Y, 16M, 16C and 16K, laser units 17Y, 17M, 17C and 17K, transfer rollers 18Y, 18M, 18C and 18K, fusing apparatus 20, sheet ejecting roller 19, and the like.

The cassette 11 stores sheets.

The sheet feeding roller 12 pulls out the sheet stored in the cassette 11 one sheet at a time.

The conveying roller 13 conveys the sheet pulled out by the sheet feeding roller 12 and conveys the sheet to the conveying belt 14.

The conveying belt 14 transfers the toner image to the sheet in coordination with the electrostatic drums 15Y, 15M, 15C and 15K.

Here, the transfer of the toner image is described using the transfer of the toner image of yellow (Y) by the electrostatic drum 15Y as an example.

The electrostatic drum 15Y is a member in a cylinder shape driven to rotate by a driving section (not shown) and the outer peripheral surface of the cylinder is charged by a charging unit (not shown). The laser unit 17Y forms an electrostatic latent image on the outer peripheral surface of the electrostatic drum 15Y. Specifically, the laser unit 17Y emits a laser according to the image of yellow formed on the sheet based on the print data on the outer peripheral surface of the charged electrostatic drum 15Y.

The print unit 16Y forms a toner image of yellow (Y) on the outer peripheral surface of the electrostatic drum 15Y.

Specifically, the print unit 16Y includes a toner cartridge and a developing unit. The toner cartridge stores toner of yellow (Y) and supplies the toner to the developing unit. The developing unit performs developing processing and applies toner of the toner cartridge on the electrostatic latent image formed on the outer peripheral surface of the electrostatic drum 15Y. With the developing processing, the toner image of yellow (Y) is formed on the outer peripheral surface of the electrostatic drum 15Y.

The transfer roller 18Y transfers the toner image of yellow (Y) formed on the outer peripheral surface of the electrostatic drum 15Y onto the sheet.

The transfer roller 18Y is provided in a position facing the electrostatic drum 15Y with the conveying belt 14 in between. The transfer roller 18Y charges the sheet with a charge opposite of the toner image at a timing when the sheet is nipped between the conveying belt 14 and the electrostatic drum 15Y (opposite charging processing). With the opposite charging processing, the toner image of yellow (Y) formed on the outer peripheral surface of the electrostatic drum 15Y is transferred on the sheet (second transfer).

Similar to the mechanism of transfer of the toner image of yellow (Y) by the above electrostatic drum 15Y, the electrostatic drum 15M transfers the toner image of magenta (M), the electrostatic drum 150 transfers the toner image of cyan (C) and the electrostatic drum 15K transfers the toner image of black (K).

The conveying belt 14 conveys the sheet on which toner images of the four colors are overlapped and transferred to the fusing apparatus 20.

The fusing apparatus 20 fuses the toner image transferred on the sheet. The details of the fusing apparatus 20 are described later.

The sheet ejecting roller 19 conveys the sheet on which the toner is fused by the fusing apparatus 20 and ejects the sheet on the sheet ejecting tray.

Figure 3:
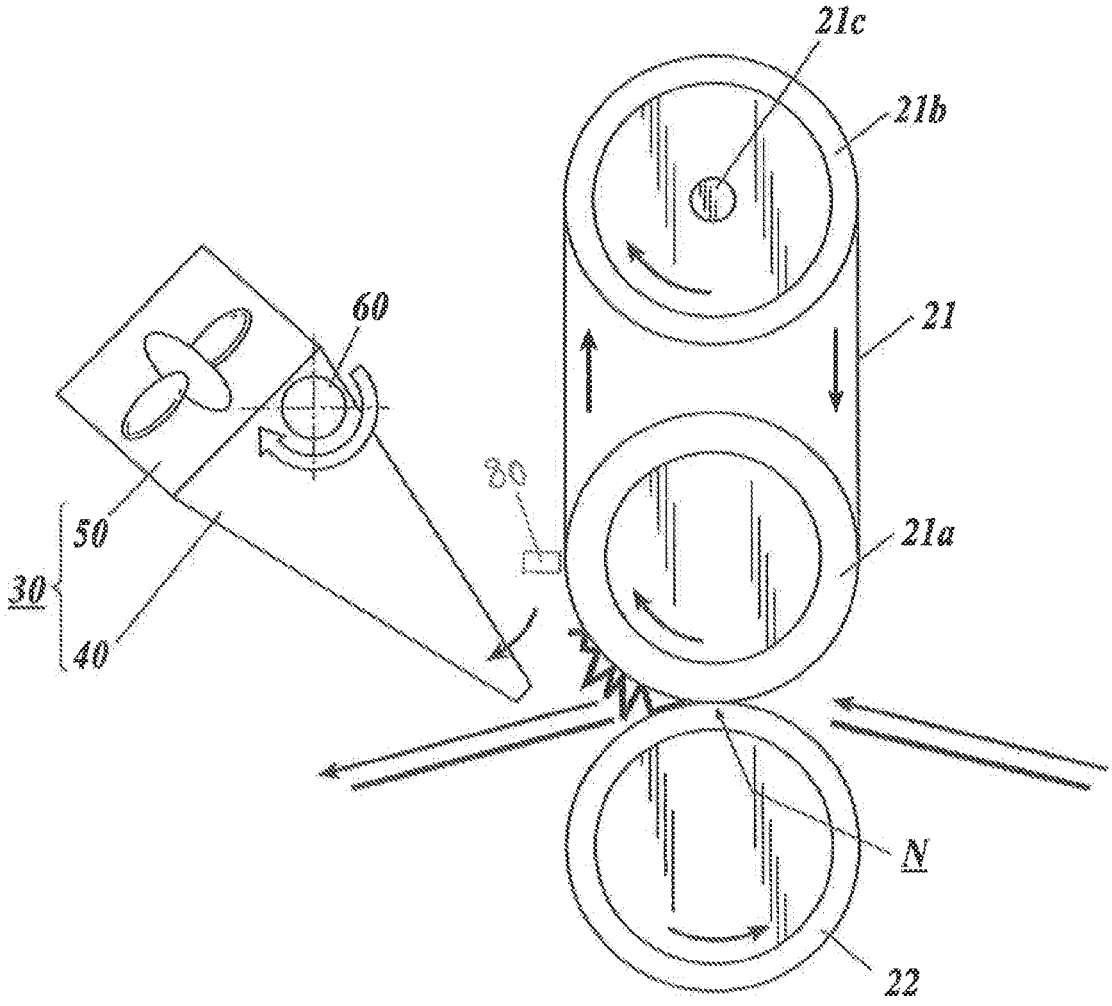
FIG. 3 is a diagram showing an example of a configuration of a fusing apparatus and a separation assisting section.

FIG. 3 is a diagram showing an example of a configuration of a fusing apparatus 20 and a separation assisting section 30.

The fusing apparatus 20 includes a fusing belt 21 and a fusing roller 22.

The fusing belt 21 and the fusing roller 22 operate in coordination with each other to form a pressuring section (nipping section N) with the outer peripheral surface of the fusing belt 21 and the outer peripheral surface of the fusing roller 22. The fusing belt 21 and the fusing roller 22 driven by the driving section (not shown) nips the sheet with the nipping section N, applies pressure and heat and performs the fusing processing on the sheet. The fusing belt 21 and the fusing roller 22 perform fusing processing on the sheet in the nipping section N. The fusing belt 21 and the fusing roller 22 perform the fusing processing on the sheet with the nipping section N while conveying the sheet in a predetermined direction.

The following describes the fusing apparatus 20 in detail.

The fusing belt 21 is a belt continuous as one so as to surround a plurality of rollers (for example, roller 21*a* and 21*b* shown in FIG. 3).

The roller 21*a* and the roller 21*b* are rollers provided on the inner side of the fusing belt 21. The roller 21*a* and the roller 21*b* are provided so that the outer peripheral surface is in contact with the inner side of the fusing belt 21 and the fusing belt 21 is extended across both the roller 21*a* and the roller 21*b*.

The fusing roller 22 is provided in a position which faces one of the plurality of rollers (for example, roller 21*a* shown in FIG. 3) which extends the fusing belt 21, with the fusing belt 21 in between. In coordination with the roller 21*a*, the fusing roller 22 nips the fusing belt 21, and the outer peripheral surface of the fusing belt 21 and the outer peripheral surface of the fusing roller 22 form the pressuring section (nipping section N).

The roller 21*a*, the roller 21*b* and the fusing roller 22 are driven to rotate by the driving section (not shown). The fusing belt 21 is driven by the rotating motion of the roller 21*a* and the roller 21*b*. The fusing roller 22 is driven to rotate in the opposite direction from the rotating direction of the roller 21*a*. The driven fusing belt 21 and the driven fusing roller 22 operate in coordination with each other to nip the sheet with the nipping section N and to convey the sheet while applying pressure.

At least one of the plurality of rollers (for example, roller 21*b* shown in FIG. 3) is heated by the heating section (for example, beating section 21*c* provided on the inner side of the roller 21*b* shown in FIG. 3). The roller 21*b* heated by the heating section 21*c* transmits the heat to the fusing belt 21. The heat, is transmitted from the roller 21*b* and the fusing belt 21 is heated. The heated fusing belt 21 transmits the heat to the sheet nipped by the nipping section N to heat the sheet.

The fusing belt 21 and the fusing roller 22 perform fusing processing on the sheet in the nipping section N, convey the sheet on which fusing processing is performed to eject the sheet to the downstream side of the conveying direction. The descriptions of "upstream side" or "downstream side" described below are descriptions based on the conveying direction of the sheet.

A separation assisting section 30 is provided to function, as an injecting section at the downstream side of the nipping section N. The separation assisting section 30 separates from the fusing belt 21 the sheet attached to the fusing belt 21 at the downstream side of the nipping section N.

As shown in FIG. 3, the separation assisting section 30 includes a nozzle 40 and a jet flow generating section 50. The separation assisting section 30 is supported by a supporting member 60.

The nozzle 40 is provided on the downstream side of the conveying direction of the sheet in the nipping section N. The nozzle 40 injects a jet flow of gas generated by the jet flow generating section (for example, jet flow generating section 50 as shown in FIG. 3) which generates a jet flow of gas (for example air, etc.) between the sheet conveyed (ejected) by the nipping section N and attached to the fusing belt 21 and the fusing belt 21.

Figure 4:
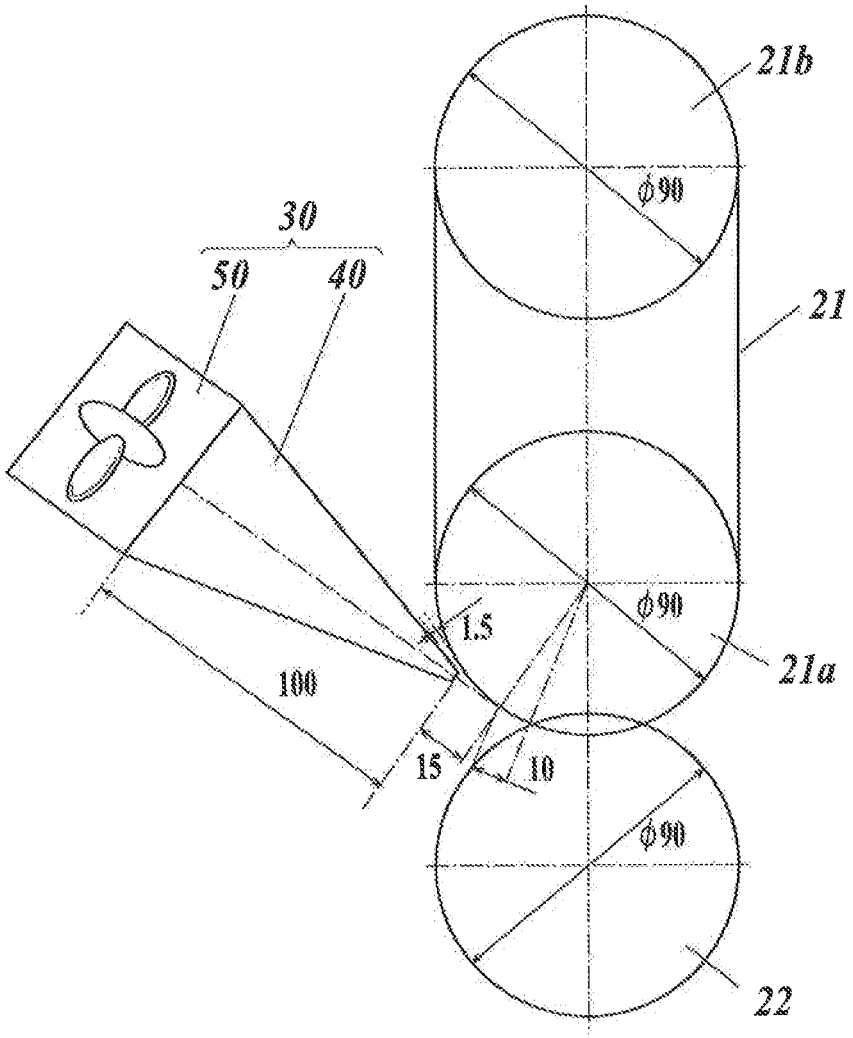
FIG. 4 is a diagram showing an example of size and relation of position of each section of the fusing apparatus and the nozzle.

FIG. 4 is a diagram showing an example of size and relation of position of each section of the fusing apparatus 20 and the nozzle 40. The unit of the numeric value shown in FIG. 4 is millimeter ([mm]).

The nozzle 40 injects a gas to a predetermined position on the outer peripheral surface of the fusing belt 21 extended by the rollers 21*a* and 21*b* from the downstream side to the upstream side. Specifically, for example, as shown in FIG. 4, the nozzle 40 guides the injection of gas from a position where the tip of the nozzle 40, which is to be the injection opening to inject air, is a position separated a predetermined distance (for example, 15 [mm]) with respect to the outer peripheral surface of the predetermined position of the fusing belt 21, which is positioned a predetermined length (for example, 10 [mm]) to the downstream side from the edge section of the downstream side of the nipping section N, to the outer peripheral surface of the predetermined position. The nozzle 40 guides the injection of gas from a position where the distance between the nozzle 40 and the fusing belt 21 is closest is a predetermined distance (for example, 1.5 [mm]).

The jet flow generating section 50 causes a jet flow of gas (for example, air, etc.).

Specifically, for example, the jet flow generating section 50 is an axial flow fan of a predetermined diameter (for example, 60 [mm]) and the power source circuit 108 supplies electric power to rotate blades so that air is sucked from one side and ejected to the other side. The other side of the let flow generating section 50, in other words, the side to which air is ejected is connected to an air flow path of the nozzle 40. The air ejected from the other side of the jet flow generating section 50 is collected and injected by the nozzle 40. A blocking member (for example, sponge, etc.) is provided in the joint between the jet flow generating section 50 and the nozzle 40 to prevent leakage of gas (for example, leakage of air, etc.) after closing the joint.

The supporting member 60 rotatably supports the separation assisting section 30.

Specifically, the supporting member 60 is provided for example, near the joint, between the jet flow generating section 50 and the nozzle 40, and axially supports the nozzle 40 at the far side (for example, upper side shown in FIG. 3 to FIG. 5) from the conveying path of the sheet ejected from the nipping section N.

Figure 5A:
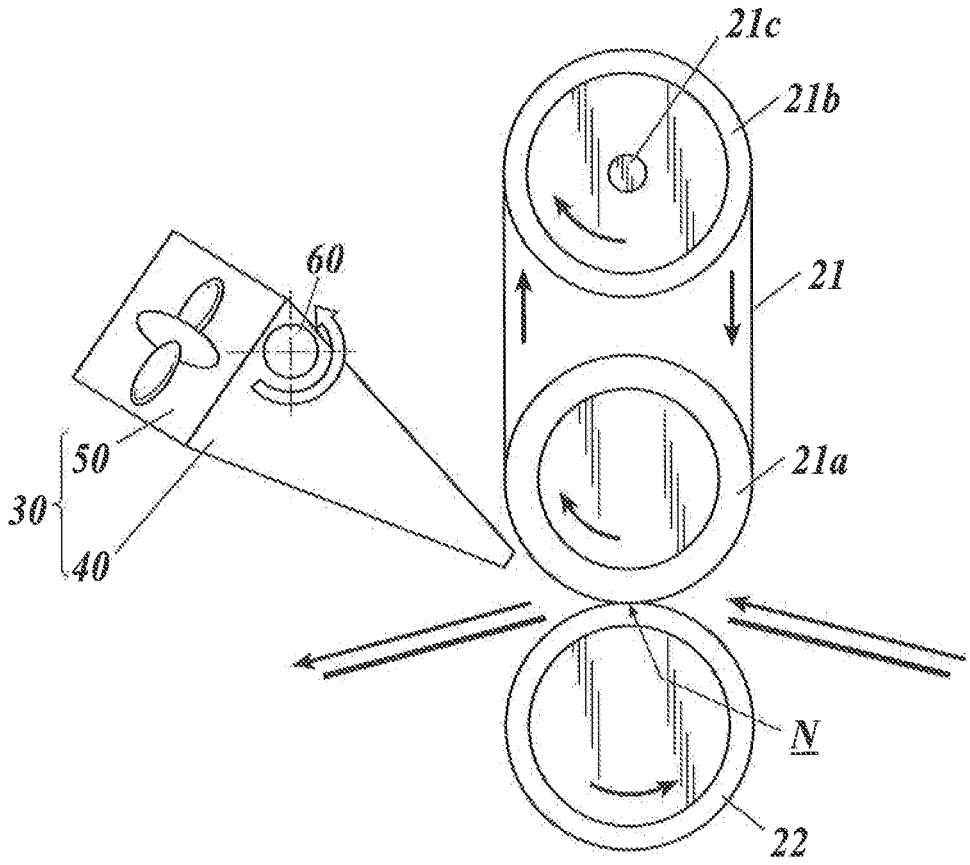
FIG. 5A is a diagram showing an example of a position before separation from the fusing apparatus by rotating motion of the separation assisting section and a diagram showing an example of the rotating angle of the separation assisting section when the gas is injected as shown in FIG. 4.
Figure 5B:
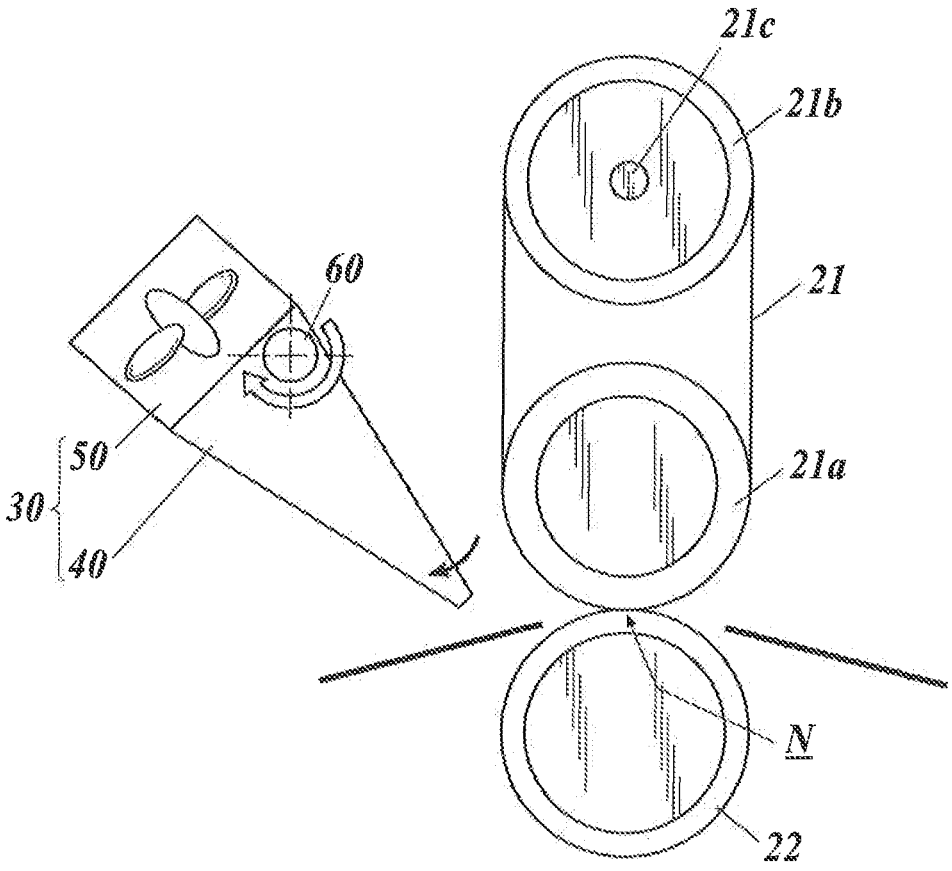
FIG. 5B is a diagram showing an example of a position after separation from the fusing apparatus by the rotating motion of the separation assisting section and a diagram showing an example of the rotating angle of the separation assisting section separated from the fusing apparatus.

FIG. 5A and FIG. 5E is a diagram showing an example of a position before and after separation from the fusing apparatus 20 by the rotating motion of the separation assisting section 30. FIG. 5A is a diagram showing an example of a rotating angle of the separation assisting section 30 when the gas is injected, as shown in FIG. 4. FIG. 5B is a diagram showing an example of a rotating angle where the separation assisting section 30 is separated from the fusing apparatus 20.

When image forming by the image forming section 106 is performed and jamming of the recording medium is not occurring (for example, sheet jamming, etc.), as shown in FIG. 4 and FIG. 5A, the separation assisting section 30 of the present embodiment is maintained in a predetermined rotating angle (injection angle) to inject the gas between the sheet conveyed from the nipping section and attached to the fusing belt 21 and the fusing belt 21. When the jamming of the recording medium occurs, as shown in FIG. 5B, for example, the separation assisting section 30 is provided to be a rotating angle (separation angle) so that the tip side of the nozzle 40 is separated from the fusing apparatus 20 than when the separation assisting section 30 is in the position of the injection angle. The switching operation of the rotating angle of the separation assisting section 30 is performed by driving of the position switching section 107.

The position switching section 107 switches the rotating angle of the separation assisting section 30.

Specifically, for example, the position switching section 107 includes a driving section 107*a* which rotates a separation assisting section 30 positioned in the separation angle to be positioned in the injection angle, a maintaining section 107*b* which maintains the separation assisting section 30 in the injection angle, and a separation guiding section 107*c* which allows the separation assisting section 30 to be positioned in the separation angle when there is no rotating motion or maintaining of the separation assisting section 30 by the driving section 107*a*.

Specifically, the driving section 107*a* is, for example, an electric motor or an actuator and drives by electric power supply from the electric power source circuit 108. The driving section 107*a* drives so that the separation assisting section 30 in the separation angle is lifted and rotated so that the tip of the nozzle 40 is near the fusing belt 21 and the separation assisting section 30 is positioned in the injection angle.

In the present embodiment, a latching section (not shown) is provided to latch the separation assisting section 30 to prevent the nozzle 40 from being nearer to the fusing belt 21 than the relation of the position between the nozzle 40 and the fusing belt 21 when the separation assisting section 30 is positioned in the injection angle. When the separation assisting section 30 is driven by the driving section 107*a* so as to be positioned in the injection angle, the separation assisting section 30 comes into contact with the latching section and is latched.

The maintaining section 107*b* is, for example an electromagnet provided in a position to be engaged with a first engaging section of the separation assisting section 30. At least the portion (contacting section) of the engaging section in contact with the separation assisting section 30 is composed of metal, etc. including paramagnetic properties. The maintaining section 107*b* causes magnetic force by electric power supply from the power source circuit 108, and the separation assisting section 30 and the contacting section of the engaging section are pulled to each other to come into contact with each other so that the rotating angle of the separation assisting section 30 is positioned at the injection angle.

The separation guiding section 107*c* is, for example, a spring with predetermined pressing force or pulling force, and applies force to the separation assisting section 30 in a direction to separate the tip side of the nozzle 40 of the separation assisting section 30 with respect to the injection angle from the fusing apparatus 20. When the driving section 107*a* and the maintaining section 107*b* are not driven, the separation guiding section 107*c* separates the tip side of the nozzle 40 of the separation assisting section 30 from the fusing apparatus 20.

The driving force of the driving section 107*a* which rotates the separation assisting section 30 and the maintaining force of the maintaining section 107*b* which maintains the rotating angle of the separation assisting section 30 in contact with the engaging section by magnetic force are stronger than the force of the separation guiding section 107*c* in the direction to separate the tip side of the nozzle 40 of the separation assisting section 30 from the fusing apparatus 20.

The power source circuit 108 supplies electric power to the jet flow generating section 50, the driving section 107*a* and the maintaining section 107*b*. The power source circuit 108 is, for example a power source circuit in which the voltage supplied by the pulse width modulation (PWM) can be changed, and controls the voltage to be applied to operate each of the jet flow generating section 50, the driving section 107*a* and the maintaining section 107*b* according to control of the control section 101.

The jamming detecting section 109 detects jamming of the recording medium in the conveying path of the recording medium (for example, sheet, etc.).

Specifically, the jamming detecting section 109 includes, for example, a sensor 80, etc. which detects that the sheet entered a predetermined position which is outside the conveying path of the sheet during the image forming, and outputs to the control section 101 a signal (jamming detection signal) which snows sheet jamming occurred when the sensor 80 detects the sheet. The sensor 80 of the jamming detecting section 109 is, for example provided so as to be able to detect the sheet entering between the separation assisting section 30 and the fusing belt 21. With this, the detection signal is input when the sheet is not separated from the fusing belt 21 and enters between the separation assisting section 30 and the fusing belt 21. Consequently, the control section 101 can detect entering of the sheet which may cause sheet jamming.

The sensor 80 of the detecting section 109 is not limited to one, and a plurality of sensors can be provided, and the position is not limited to between the separation assisting section 30 and the fusing belt 21. For example, the image forming apparatus 1 can include a plurality of sensors provided along a conveying path of the sheet when image forming is performed normally and the control section 101 can judge whether or not the sheet is conveyed according to the performing timing of each processing during image forming. In this case, when it is detected that the sheet is not in the conveying position of the sheet according to the performing timing of each processing during image forming, the control section 101 judges that sheet jamming occurred.

Next, various processing regarding operation of the separation assisting section 30 by the control section 101 is described. The control section 101 controls the power source circuit 108 and controls the operation of the driving section 107*a* and the maintaining section 107*b* to control the rotating angle of the separation assisting section 30.

For example, when the image forming is not performed, the control section 101 does not operate the driving section 107*a* and the maintaining section 107*b*. Therefore, the separation assisting section 30 is positioned to be in the separation angle by the separation guiding section 107*c*.

When start of image forming based on input by the user is instructed, the control section 101 operates each section of the image forming apparatus 1 and performs image forming. Here, the control section, 101 pulls out the sheet from the cassette 11 and also operates the driving section 107*a* and the maintaining section 107*b* to position the separation assisting section 30 in the injection angle. Specifically, for example, the control section 101 operates the driving section 107*a* to position the separation assisting section 30 in the injection angle and operates the maintaining section 107*b* to maintain a state so that the separation assisting section 30 is positioned in the injection angle. Here, when the separation assisting section 30 is maintained positioned in the injection angle by the operation of the maintaining section 107*b*, the control section 101 returns the operation state of the driving section 107*a* to a state before rotating the separation assisting section 30 and ends the operation of the driving section 107*a*.

The control section 101 operates the jet flow generating section 50 to inject air from the tip of the nozzle 40. For example, the control section 101 operates the jet flow generating section 50 so that the injection of air from the tip of the nozzle 40 is stable when the first sheet pulled out from the cassette 11 passes the nipping section N. From the tip of the nozzle 40, a predetermined air flow (for example, 40 [m/s]) is injected between the sheet conveyed (ejected) by the nipping section N and attached to the fusing belt 21 and the fusing belt 21. With this, the sheet can be favorably separated from the fusing belt 21. Consequently, the reduction of image quality which may occur when the sheet conveyed (ejected) by the nipping section N and attached to the fusing belt 21 continues to be attached to the fusing belt 21 for a predetermined amount of elapsed time or more (for example, 20 [msec]) can be prevented.

The control section 101 maintains the operation of the maintaining section 107*b* and the jet flow generating section 50 while the image forming is performed.

When the jamming detection signal is output from the jamming detecting section 109 during the image forming, the control section 101 stops the operation of the maintaining section 107*b* and the jet flow generating section 50. With this, the separation assisting section 30 loses maintaining force to maintain the injection angle and the separation guiding section 107*c* rotates the tip side of the nozzle 40 to separate the tip side of the nozzle 40 from the fusing apparatus 20. In other words, the control section 101 controls the operation of the driving section 107*a* and the maintaining section 107*b* to position the separation assisting section 30 in the injection angle when image forming is performed, and to separate the separation assisting section 30 from the fusing apparatus 20 to position the separation assisting section 30 in the separation angle when sheet jamming occurs.

In other words, when the jamming (sheet jamming) of the sheet is detected by the jamming detecting section 109, the control section 101 and the position switching section 107 function in coordination as a separating section which separates the separation assisting section 30 from the fusing apparatus 20.

After the sheet jamming occurs, when the sheet jamming is resolved and the image forming is restarted, the control section 101 operates the driving section 107*a* and the maintaining section 107*b* again so that the separation assisting section 30 is positioned in the injection angle and the jet flow generating section 50 is operated.

After the image forming ends, the control section 101 ends the operation of the maintaining section 107*b*. With this, the separation assisting section 30 is positioned in the separation angle by the separation guiding section 107*c*.

In other words, when the image forming is not performed on the sheet by the image forming apparatus 1, the separation guiding section 107*c* separates the separation assisting section 30 from the fusing apparatus 20.

According to the image forming apparatus 1 of the present embodiment, when the jamming (sheet jamming) in the conveying path of the sheet is detected by the jamming detecting section 109, the control section 101 operates in coordination with the position switching section 107 and separates the separation assisting section 30 from the fusing apparatus 20.

With this, when sheet jamming occurs, the separation assisting section 30 can be separated from the fusing apparatus 20, and the distance between the separation assisting section 30 and the fusing apparatus 20 can be made larger than the distance between the separation assisting section 30 and the fusing apparatus 20 when the separation assisting section 30 injects gas (for example, air, etc.) between the sheet attached to the fusing belt 21 of the fusing apparatus 20 and the fusing belt 21. Conventionally, there is a problem where the sheet not completely separated from the fusing belt being pushed in a narrow space between the tip of the nozzle and the belt when the belt operates and causing jamming and the pushed and jammed sheet causing damage to the belt, etc. of the fusing apparatus. However, according to the present embodiment, by making the distance between the separation assisting section 30 and the fusing apparatus 20 large when the sheet lamming occurs, the sheet jamming between the separation assisting section 30 and the fusing apparatus 20 can be preferably prevented. Even if the sheet is jammed between the separation assisting section 30 and the fusing apparatus 20, the distance between the separation assisting section 30 and the fusing apparatus 20 is large. Therefore, the jammed sheet can be in a large space, and with this, the sheet not being able to be ejected, receiving pressing force and being pressured can be favorably prevented. Therefore, in the image forming apparatus 1 of the present embodiment, the jammed sheet not being able to be ejected does not add pressing force to the fusing apparatus 20 side and does not damage the belt, etc. of the fusing apparatus 20. Therefore, according to the image forming apparatus 1 of the present embodiment, when sheet jamming occurs, the separation assisting section 30 is separated from the fusing apparatus 20 and the jammed sheet damaging the belt, etc. of the fusing apparatus can be favorably prevented.

When the sheet is jammed between the separation assisting section 30 and the fusing apparatus 20, the separation assisting section 30 is separated from the fusing apparatus 20, and a large distance is provided between the separation assisting section 30 and the fusing apparatus 20, therefore, the user can easily perform operation of removing the jammed sheet.

Even if the distance between the separation assisting section 30 and the fusing apparatus 20 when the separation assisting section 30 injects air between the sheet attached to the fusing belt 21 of the fusing apparatus 20 and the fusing belt 21 is small, when sheet jamming occurs, the separation assisting section 30 is separated from the fusing apparatus 20 and the damage of the fusing apparatus 20 can be favorably prevented. Therefore, the distance between the separation assisting section 30 and the fusing apparatus 20 when the separation assisting section 30 injects air between the sheet attached to the fusing belt 21 of the fusing apparatus 20 and the fusing belt 21 can be made small and injection of air to separate the sheet can be performed with preferable conditions.

When the image forming apparatus 1 does not perform image forming on the sheet, the control section 101 and the position switching section 107 operate in coordination with each other to separate the separation assisting section 30 from the fusing apparatus 20.

With this, the distance between the separation assisting section 30 and the fusing apparatus 20 when the image forming apparatus 1 is not performing image forming on the sheet can be made large compared to the distance between the separation assisting section 30 and the fusing apparatus 20 when the separation assisting section 30 injects air between the sheet attached to the fusing belt 21 of the fusing apparatus 20 and the fusing belt 21. Therefore, when exchange of the components of the separation assisting section 30 or the fusing apparatus 20 or some of the components of the above configuration is performed, a large work space can be provided for performing the component exchange. Consequently, the mechanic of the image forming apparatus 1 can easily perform exchange of the component.

The image forming apparatus 1 includes a supporting member (for example, supporting member 60) which supports the separation assisting section 30 to be able to move along a predetermined movement path. Then, the control section 101 and the position switching section 107 operate in coordination with each other to move the separation assisting section 30 along a predetermined movement path to separate the separation assisting section 30 from the fusing apparatus 20.

With this, the movement path when the separation assisting section 30 is separated from the fusing apparatus 20 is determined to be a predetermined movement path. Therefore, by securing a state in which the separation assisting section 30 can move (for example, movement space, etc.) along the predetermined movement path around the separation assisting section 30, the separation assisting section 30 can be favorably separated from the fusing apparatus 20.

The supporting member 60 rotatably supports the separation assisting section 30. The control section 101 and the position switching section 107 operate in coordination with each other to rotate the separation assisting section 30 to separate the separation, assisting section 30 from the fusing apparatus 20.

With this, when the separation assisting section 30 is separated from the fusing apparatus 20, a rotating axis is provided in a portion where a sufficient distance is secured between the separation assisting section 30 and the fusing apparatus 20 when air is injected, and the portion of the separation assisting section 30 closest to the fusing apparatus 20 when air is injected (for example, tip side, etc. of the nozzle 40) can be largely rotated, and the separation assisting section 30 and the fusing apparatus 20 can be sufficiently separated by minimum movement of the separation assisting section 30. With this, the space to separate the separation assisting section 30 from the fusing apparatus 20 can be made small.

The image forming apparatus 1 includes a maintaining section 107*b* which maintains the separation assisting section 30 at a position where the gas is injected between the sheet conveyed by the nipping section N and attached to the fusing belt 21 and the fusing belt 21 and a control section 101 which releases the position of the separation assisting section 30 maintained by the maintaining section 107*b* when the jamming detecting section 109 detects sheet jamming. Then, the separation guiding section 107*c* separates the separation assisting section 30 from the fusing apparatus 20 when the position of the separation assisting section 30 maintained by the maintaining section 107*b* is released.

With this, the positioning of the separation assisting section 30 when the gas is injected between the sheet attached to the fusing belt 21 and the fusing belt 21 can be performed with the maintaining section 107*b*. Therefore, when the image forming is performed again after the separation assisting section 30 is separated from the fusing apparatus 20, the separation assisting section 30 can be easily provided, in a position when the gas is injected between the sheet attached to the fusing belt 21 and the fusing belt 21. Moreover, the detection of sheet jamming by the jamming detecting section 109 and the release of the position of the separation assisting section 30 maintained by the maintaining section 107*b* are linked. Therefore, when sheet jamming occurs, the separation guiding section 107*c* can favorably separate the separation assisting section 30 from the fusing apparatus 20.

In an example where a plurality of sensors are provided along a conveying path of a sheet when image forming is performed normally as a jamming detecting section 109 and the control section 101 judges whether or not the sheet is conveyed according to the performing timing of each processing in the image forming, when it is detected that there is no sheet in the conveying position of the sheet according to the performing timing of each processing in the image forming, the control section 101 judges sheet jamming occurred and separates the separation assisting section 30 from the fusing apparatus 20. With this, when sheet jamming occurs in any of the configuration of the image forming apparatus 1 regarding the conveying path of the sheet including the configuration other than the fusing apparatus 20 and the sheet needs to pass the fusing apparatus 2 to cure the sheet jamming, since the separation assisting section 30 is separated from the fusing apparatus 20, the sheet jamming between the separation assisting section 30 and the fusing apparatus 20 when the sheet is passed through the fusing apparatus 20 to cure the sheet jamming can be favorably prevented. Therefore, when the sheet is passed through the fusing apparatus 20 to eject the sheet to cure the sheet jamming, the sheet jamming between the separation assisting section 30 and the fusing apparatus 20 can be favorably prevented.

There is no continuous consumption (for example, use of electric power, etc.) by the separation guiding section 107*c* to separate the separation assisting section 30, and therefore, the separation of the separation assisting section 30 from the fusing apparatus 20 when image forming is not performed can be performed at a very low cost, and is economical as well as superior in view of environment conservation.

Second Embodiment

Figure 6:
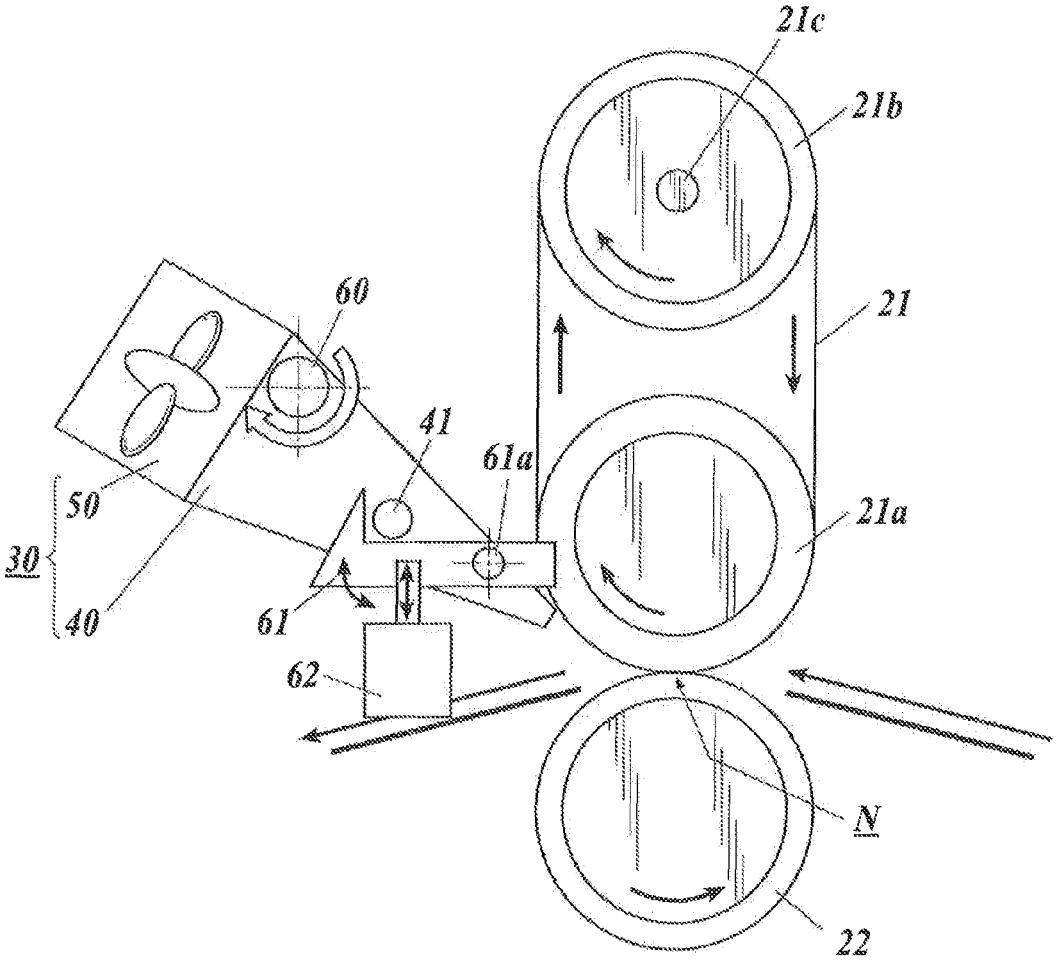
FIG. 6 is a diagram showing an example of a configuration of a separation assisting section of a second embodiment.

Next, the second embodiment of the present invention is described with reference to FIG. 6. The same reference numeral is applied to the configuration similar to the first embodiment and the description is omitted.

The position switching section 107 of the second embodiment includes a maintaining instrument 61 and maintaining instrument supporting section 62 instead of the maintaining section 107*b*.

Figure 7:
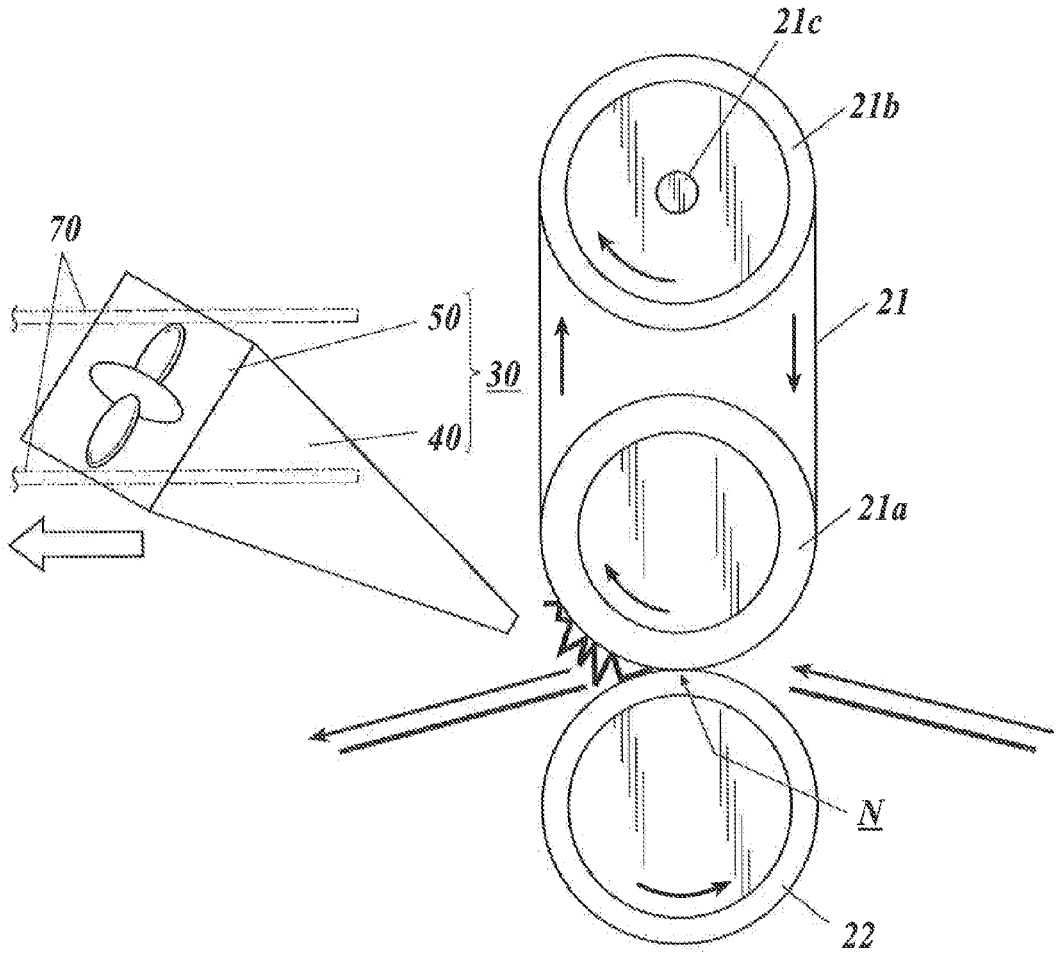
FIG. 7 is a diagram showing an example of a configuration of a separation assisting section of a third embodiment.

The maintaining instrument 61 is a member which engages with a predetermined engaging section (for example, an engaging section 41 provided on the nozzle 40 shown in FIG. 7) provided on the separation assisting section 30. The maintaining instrument 61 is rotatably provided with a rotating axis (for example, rotating axis 61*a* shown in FIG. 7) provided in a predetermined position as the center.

The maintaining instrument supporting section 62 changes the rotating angle of the maintaining instrument 61. Specifically, for example, the maintaining instrument supporting section 62 is an actuator causing linear motion of the plunger by electromagnetic force. As shown in FIG. 7, the maintaining instrument supporting section 62 is provided to support the maintaining instrument 61 by the tip of the plunger from below.

The control section 101 of the second embodiment controls the operation of the maintaining instrument supporting section 62 instead of the operation control of the maintaining section 107*b* of the first embodiment.

For example, in image forming, after the separation assisting section 30 is positioned in the injection angle by the operation of the driving section 107*a*, the control section 101 operates the maintaining instrument supporting section 62 so that the plunger is projected. The plunger is projected by operation so that the maintaining instrument supporting section 62 pushes up the maintaining instrument 61 from below and supports the maintaining instrument 61 at the pushed up position. With this, the separation assisting section 30 engaged with the maintaining instrument 61 is maintained in the position of the injection angle.

When sheet jamming occurs or image forming ends, the control section 101 operates the maintaining instrument supporting section 62 to store the plunger. The plunger is stored by operation so that the maintaining instrument supporting section 62 releases the pushing and the maintaining of the maintaining instrument 61. With this, the separation assisting section 30 loses maintaining power maintained by the injection angle and the separation guiding section 107*c* rotates the tip side of the nozzle 40 to separate the separation assisting section 30 from the fusing apparatus 20.

According to the above described second embodiment, the effects similar to the first embodiment can be achieved.

Third Embodiment

Next, the third embodiment of the present invention is described with reference to FIG. 7. The same reference numeral is applied to the configuration similar to the first and second embodiment and the description is omitted.

The separation assisting section 30 of the third embodiment includes guide rail members 70 and 70 which support the separation assisting section 30 to enable linear motion instead of the supporting member 60 which rotatably supports the separation assisting section 30 in the first embodiment.

The guide rail members 70 and 70 support the separation assisting section 30 to enable linear motion along a predetermined direction. Here, for example, as shown in FIG. 7, the predetermined direction is a direction orthogonal to the planar portion of the fusing belt 21 positioned between the roller 21*a* and the roller 21*b*. However, the above is one example and the embodiment is not limited to the above. The linear motion direction of the separation assisting section 30 determined by the guide rail members 70 and 70 can be a direction which can be switched between the separation assisting section 30 being close to and being separated from the fusing apparatus 20.

The driving section 107*a* of the third embodiment operates to bring the separation assisting section 30 close to the fusing belt 21. Specifically, for example, the driving section 107*a* moves the separation assisting section 30 along the guide rail members 70 and 70 to be in a position similar to the relation of position shown in FIG. 4.

The maintaining section 107*b* of the third embodiment maintains the separation assisting section 30 moved, by the driving section 107*a* in a position similar to the relation of position shown in FIG. 4.

The separation guiding section 107*c* of the third embodiment applies force to the separation assisting section 30 in the direction to separate the separation assisting section 30 from the fusing apparatus 20 along the guide rail members 70 and 70 with respect to the position of the separation assisting section 30 positioned in the relation of position of the separation assisting section 30 and the fusing apparatus 20 as shown in FIG. 4.

The differences from the first embodiment regarding the various processing of the operation of the separation assisting section 30 by the control section 101 in the third embodiment is described.

For example, in a state where image forming is not performed, the control section 101 does not operate the driving section 107*a* and the maintaining section 107*b*. Therefore, the separation assisting section 30 is positioned in a position separated from the fusing apparatus 20 with respect to the position of the separation assisting section 30 positioned in the relation of position of the separation assisting section 30 and the fusing apparatus 20 as shown in FIG. 4 with the separation guiding section 107*c*.

When the start of image forming is instructed, based on input by the user, the control section 101 operates the driving section 107*a* and moves the separation assisting section 30 to a position similar to the relation of position shown in FIG. 4 along the guide rail members 70 and 70. Then, the control section 101 moves the maintaining section 107*b* and maintains the position of the separation assisting section 30.

When a jamming detection signal is output from the jamming detecting section 109 during image forming, the control section 101 stops the operation of the maintaining section 107*b* and the jet flow generating section 50. With this, the separation assisting section 30 loses the maintaining force to maintain the position and the separation assisting section 30 moves so as to separate from the fusing apparatus 20 along the guide rail members 70 and 70 with respect to the position of the separation assisting section 30 in the relation of position of the separation assisting section 30 and the fusing apparatus 20 as shown in FIG. 4 with the separation guiding section 107*c*.

After sheet jamming occurs, when the sheet jamming is resolved and the image forming is restarted, the control section 101 operates the driving section 107*a* and the maintaining section 107*b* again so that the separation assisting section 30 is positioned in the position similar to the relation of position shown in FIG. 4.

After the image forming ends, the control section 101 ends the operation of the maintaining section 107*b*. With this, the separation assisting section 30 moves so as to separate from the fusing apparatus 20 with the separation guiding section 107*c*.

According to the third embodiment, effects similar to the first embodiment can be obtained. Moreover, the separation assisting section 30 is supported to enable linear motion. Therefore, compared to separating the separation assisting section 30 from the fusing apparatus 20 by rotating motion, the separation assisting section 30 can be separated from the fusing apparatus 20 even more.

The entire separation assisting section 30 can be separated from the fusing apparatus 20. Therefore, when components of the separation assisting section 30, the fusing apparatus 20 or a portion of the above configuration are exchanged, a larger work space can be provided to perform the component exchange. Consequently, the mechanic of the image forming apparatus 1 can easily perform the exchange of the component.

Fourth Embodiment

Figure 8:
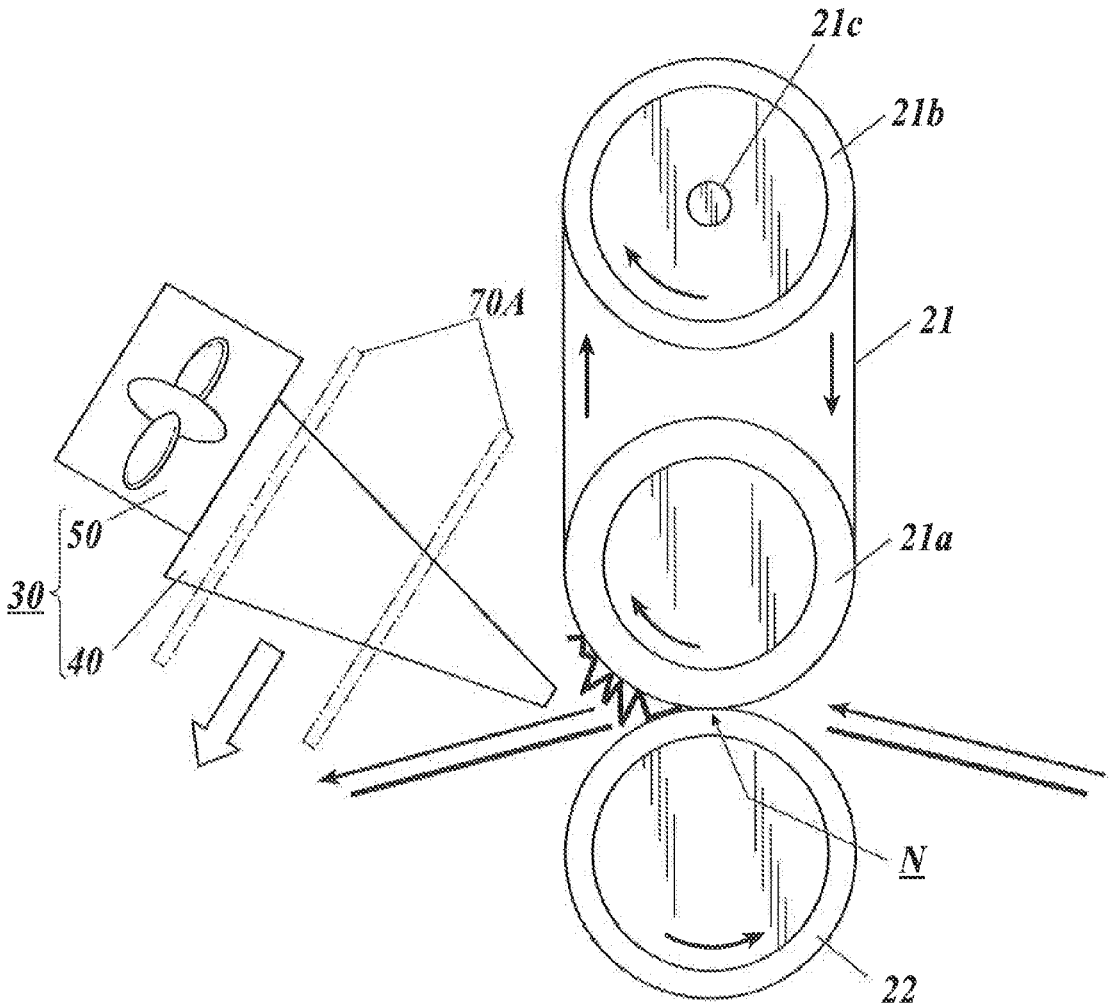
FIG. 8 is a diagram showing an example of a configuration of a separation assisting section of a fourth embodiment.

Next, the fourth embodiment of the present invention is described with reference to FIG. 8. The same reference numeral is applied to the configuration similar to the first to third embodiment and the description is omitted.

The separation assisting section 30 of the fourth embodiment includes guide rail members 70A and 70A supporting the nozzle 40 so that the nozzle 40 can move in a linear motion with respect to the jet flow generating section 50 instead of the guide rail members 70 and 70 which supports the separation assisting section 30 to enable linear motion in, the third embodiment.

The guide rail members 70A and 70A support the nozzle 40 to enable linear motion along the direction along the joint between the jet flow generating section 50 and the nozzle 40. Here, the direction of the linear motion determined by the guide rail members 70A and 70A is one example, and is not limited to the present embodiment. The direction can be any direction, which can switch between the nozzle being close to and being separated from the fusing apparatus 20.

The driving section 107*a* of the fourth embodiment operates to bring the nozzle 40 close to the fusing belt 21. Specifically, for example, the driving section 107*a* moves the nozzle 40 along the guide rail members 70A and 70A to be in a position similar to the relation of position shown in FIG. 4.

The maintaining section 107*b* of the fourth embodiment maintains the nozzle 40 moved by the driving section 107*a* in a position similar to the relation of position shown in FIG. 4.

The separation guiding section 107*c* of the fourth embodiment applies force to the nozzle 40 in the direction to separate the nozzle 40 from the fusing apparatus 20 along the guide rail members 70A and 70A with respect to the position of the nozzle 40 positioned in the relation of position of the nozzle 40 and the fusing apparatus 20 as shown in FIG. 4

The control content by the control section 101 of the fourth embodiment is similar to the third embodiment with the exception of the target of movement by the position switching section 107 being the nozzle 40 instead of the separation assisting section 30.

According to the fourth embodiment, effects similar to the first embodiment can be obtained. Moreover, since the nozzle 40 is supported to enable linear motion, the weight of the separation configuration becomes lighter compared to separating the entire separation assisting section 30 from the fusing apparatus 20 and the separation can be completed faster. Therefore, the distance between the separation assisting section 30 and the fusing apparatus 20 can be enlarged faster when sheet lamming occurs. Consequently, the sheet jammed between the separation assisting section 30 and the fusing apparatus 20 causing damage to the fusing apparatus 20 can be favorably prevented.

Since the weight of the separation configuration is light, the force necessary for the separation configuration (for example, component of the separation guiding section 107*c*, etc.) becomes small. Therefore, the separation configuration can be made smaller easily, and a configuration which saves space and which is low in cost can be made.

With a configuration in which the nozzle 40 and the jet flow generating section 50 can be separated as described in the fourth embodiment, it is not necessary to detach the jet flow generating section 50 when the nozzle 40 is exchanged, and the component exchange of the nozzle 40 can be realized efficiently. The jet flow generating section 50 can be continued to be used when only the nozzle 40 needs to be exchanged. Therefore, the cost of exchange can be reduced.

Fifth Embodiment

Figure 9:
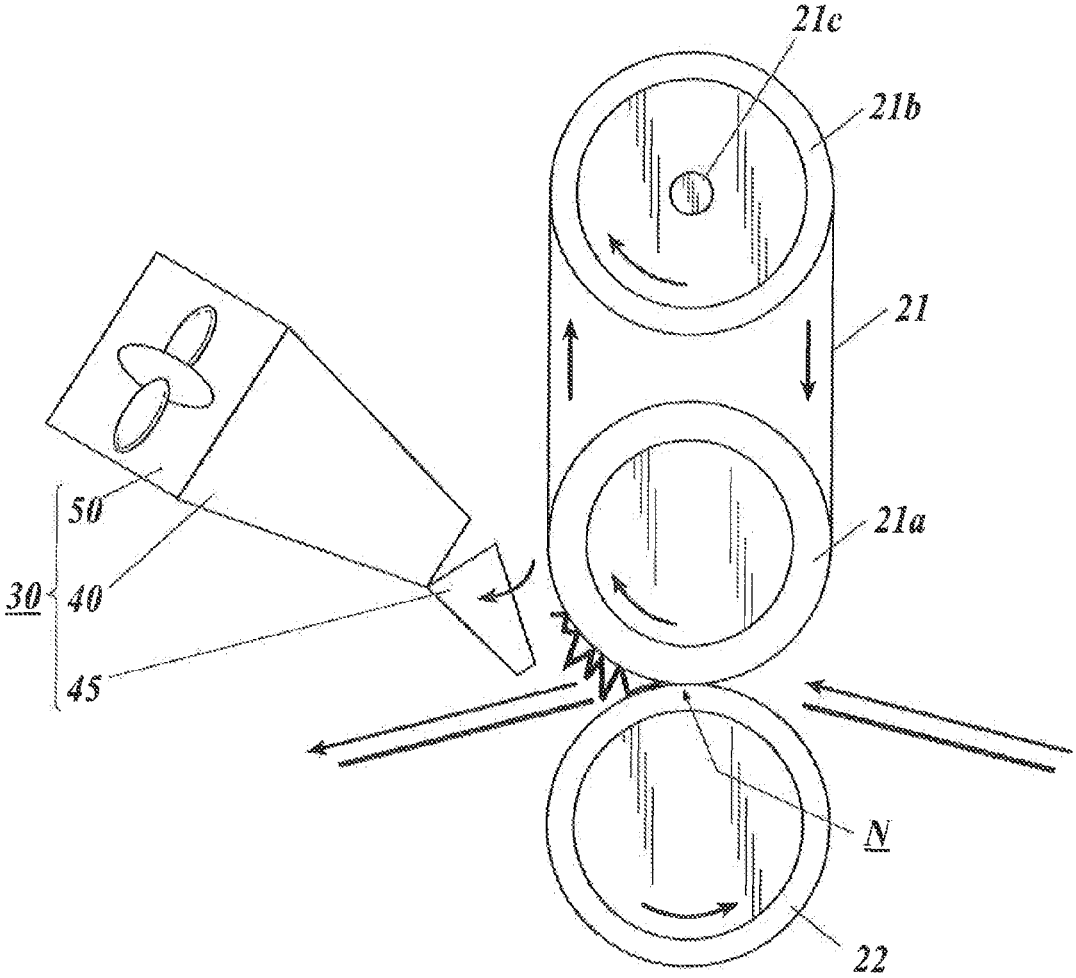
FIG. 9 is a diagram showing an example of a configuration of a separation assisting section of a fifth embodiment.
Figure 10:
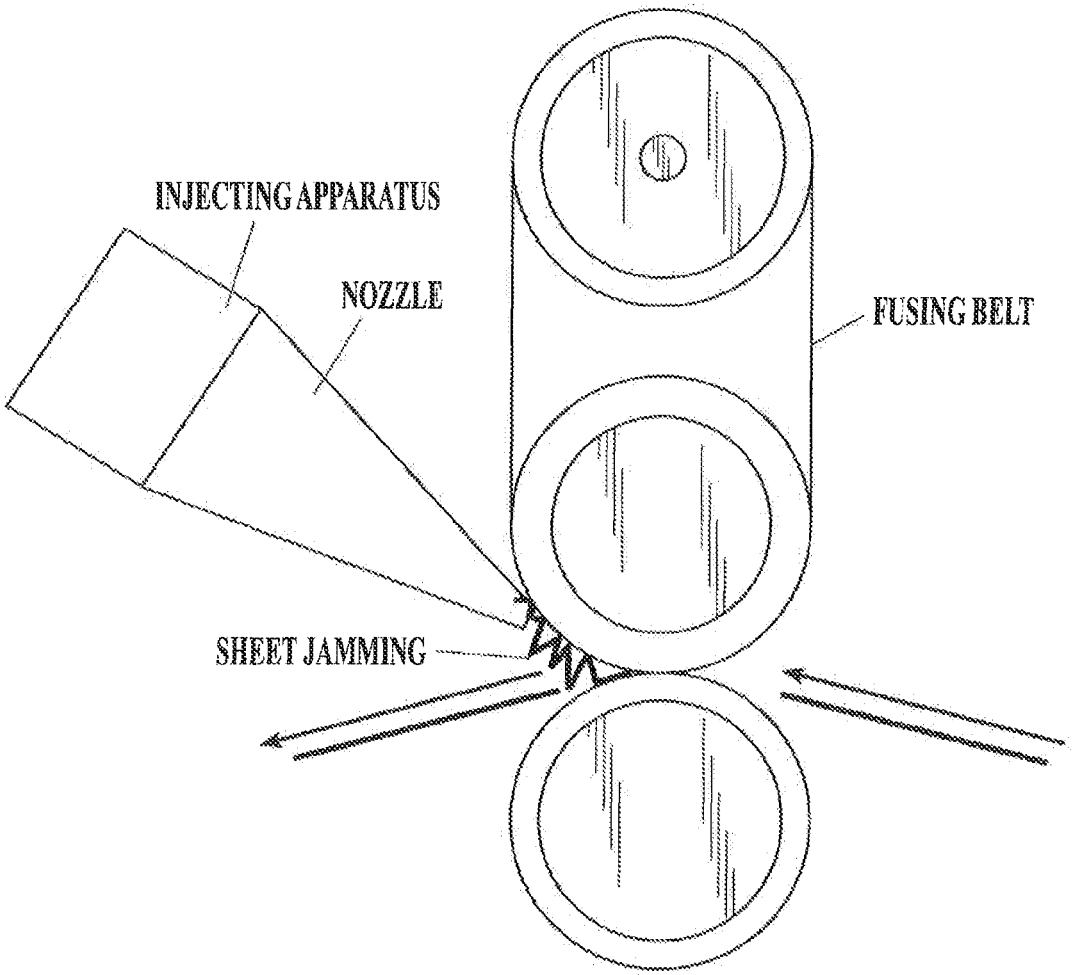
FIG.10 PRIOR ART
FIG. 10 is a diagram showing an example of a configuration of a conventional fusing apparatus and injecting apparatus.

Next, the fifth embodiment of the present invention is described with reference to FIG. 9. The same reference numeral is applied to the configuration similar to the first to fourth embodiment and the description is omitted.

The nozzle 40 of the fifth embodiment is provided so that the tip section 45 is rotatable with respect to the other portion of the nozzle 40. For example, the tip section 45 is provided to enable change of position by rotating motion between the tip position of the nozzle 40 in the relation of position between the nozzle 40 and the fusing apparatus 20 as shown in FIG. 4 and the position separated from the fusing apparatus 20 with respect to the tip position.

A blocking member (for example, sponge, etc.) is provided in the joint between the tip section 45 of the nozzle 40 and the other portion to prevent leakage of gas (for example, leakage of air, etc.) after closing the joint.

The position switching section 107 of the fifth embodiment switches the rotating angle of the tip section 45 instead, of switching the rotating angle of the separation assisting section 30 as operated by the position switching section 107 of the first embodiment. The function and operation of the configuration of the position switching section 107 and the various processing regarding the operation of the separation assisting section 30 by the control section 101 is similar to the first embodiment with the exception of the difference of the target of which the rotating angle is changed.

According to the fifth embodiment, effects similar to the first embodiment can be obtained. Moreover, a portion of the nozzle 40 (for example, tip section 45) is rotatably provided. Therefore, the weight of the separation configuration becomes lighter compared to when the entire nozzle 40 is separated from the fusing apparatus 20 and the separation can be completed faster. In other words, the distance between the separation assisting section 30 and the fusing apparatus 20 can be enlarged faster when sheet jamming occurs, and therefore, the paper jammed between the separation assisting section 30 and the fusing apparatus 20 damaging the fusing apparatus 20 can be favorably prevented.

Since the weight of the separation configuration is lighter, the force necessary for the separation configuration (for example, component of the separation guiding section 107*c*, etc.) becomes small. Therefore, the separation configuration can be made smaller easily, and a configuration which saves space and which is low in cost can be made.

The embodiments of the present invention which are disclosed above are examples in all points and do not limit the present invention. The scope of the present invention is indicated by the scope of claims described below and not the above description. The scope of the present invention includes the scope of claims and its equivalents, and modifications thereof.

For example, according to the above embodiments, a portion or the entire separation assisting section 30 or the nozzle 40 is separated from the fusing apparatus 20 by rotating motion or linear motion, however, the method of separating are merely examples and not limited to the above. For example, a portion or the entire nozzle 40 can be separated together with the separation assisting section 30. Specifically, for example, a method of separating a portion or the entire nozzle 40 by rotating motion from the fusing apparatus 20 together with separating the separation assisting section 30 from the fusing apparatus 20 by linear motion is possible. With this, the portion (for example, tip side, etc. of the nozzle 40) of the separation assisting section 30 closest to the fusing apparatus 20 when air is injected can be separated faster, and also a sufficient distance can be secured between the separation assisting section 30 and the fusing apparatus 20 by separating the separation assisting section 30 from the fusing apparatus 20.

The above embodiments show an example where a sheet is attached to the fusing belt 21, however the embodiments are not, limited to this. For example, the present invention can be applied to a configuration to separate the sheet attached to a heating roller in a fusing apparatus which uses a heating roller instead of the fusing belt 21, a fusing apparatus which uses a configuration which extends the belt member forming a nipping section N provided instead of the fusing roller 22, or a combination thereof. The roller which extends the belt can be three or more.

The target of which the position is switched by the position switching section 107, in other words, the specific content of the positioning and position switching of a portion or the entire separation assisting section 30 and nozzle 40 is one example and not limited to the above. For example, the target of which the position is switched can be separated from the fusing apparatus 20 with an electric motor or an actuator and the target of which the position is switched can be positioned in a relation of position between the nozzle 40 and the fusing apparatus 20 as shown in FIG. 4 with bias of a spring, etc. The positioning and the switching of the position of the target of which the position is switched can be performed by a configuration which can arbitrarily control operation, for example an electric motor or an actuator.

The relation of position between the nozzle 40 and the fusing apparatus 20 shown in FIG. 4 and the diameter of the rollers are merely examples and not limited to the above, and can be suitably modified according to the desired function, performance, etc. of the image forming apparatus.

The jet flow generating section 50 of the above embodiments is an axial flow fan however, the above is one example of the jet flow generating section, and is not limited to this. For example, other types of fans such as a sirocco fan can be used, or a compressor which compresses and ejects gas can be used as the let flow generating section. A plurality of nozzles can be provided on the separation assisting section 30 and the jet flow generating section of each nozzle can be provided separately.

According to the above embodiments, the jet flow generating section 50 and the nozzle 40 are connected directly. However, the jet flow generating section can be provided in a different position or outside the image forming apparatus, and can inject gas between the recording medium (for example, sheet, etc.) attached to a fusing apparatus and the fusing apparatus through a duct, etc.

The image forming of the above embodiments is color print processing which transfers toner images of four colors on a sheet. However, the color print processing is one example of image forming and is not limited to this. For example, the image forming apparatus 1 can perform black and white print processing which transfers a toner image of only one color (for example, black (K)) on a sheet.

The steps of image forming onto a sheet is described, however, the image forming apparatus 1 can perform image forming on a recording medium other than a sheet with a mechanism similar to image forming on a sheet.

The image forming section 106 is a configuration (tandem type) which transfers each of the four colors of yellow (Y), magenta (M), cyan (C), black (K) with a separate electrostatic drum, however the above configuration is one example and is not limited to the above. For example, the configuration can be a configuration which transfers using one electrostatic drum.

According to an aspect of the preferred embodiments of the present invention, there is provided a fusing apparatus comprising:

a fusing section including a nipping section which conveys a recording medium while applying pressure and heat to the recording medium;

an injecting section which is provided on a downstream side of a conveying direction of the recording medium with respect to the nipping section and which injects gas between a recording medium conveyed by the nipping section and attached to the fusing section and the fusing section;

a detecting section which detects jamming of the recording medium in a conveying path of the recording medium; and a separating section which separates the injecting section from the fusing section when jamming of the recording medium is detected by the detecting section.

According to another aspect of the preferred embodiments of the present invention, there is provided an image forming apparatus comprising:

a fusing section including a nipping section which conveys a recording medium while applying pressure and heat to the recording medium;

an injecting section which is provided on a downstream side of a conveying direction of the recording medium with respect to the nipping section and which injects gas between a recording medium conveyed by the nipping section and attached to the fusing section and the fusing section;

a detecting section which detects jamming of the recording medium in a conveying path of the recording medium; and a separating section which separates the injecting section from the fusing section when jamming of the recording medium is detected by the detecting section.

Consequently, the damage of the fusing apparatus due to the jamming of the recording apparatus can be prevented.

Preferably, the separating section separates the injecting section from the fusing section when the image forming apparatus is not forming an image on the recording medium.

Preferably, the above further includes:

a supporting member which supports the injecting section to enable movement along a predetermined movement path, wherein the separating section moves the injecting section along the predetermined movement path to separate the injecting section from the fusing section.

Preferably, the supporting member supports the injecting section to enable rotating motion; and the separating section separates the injecting section from the fusing section by rotating motion of the injecting section.

Preferably, the supporting member supports the injecting section to enable linear motion; and the separating section separates the injecting section from the fusing section by linear motion of the injecting section.

Preferably, the above further includes:

a maintaining section which maintains the injecting section in a position where gas is injected between a recording medium conveyed by the nipping section and attached to the fusing section and the fusing section; and a releasing section which releases the position of the injecting section maintained by the maintaining section when the detecting section detects jamming of the recording medium, wherein the separating section separates the injecting section from the fusing section when the releasing section releases the position of the injecting section maintained by the maintaining section.

Preferably, the injecting section includes:

a jet flow generating section which generates a jet flow of a gas; and a nozzle provided on a downstream side of a conveying direction of the recording medium with respect to the nipping section wherein the nozzle injects a jet flow of gas generated by the jet flow generating section between a recording medium conveyed by the nipping section and attached to the fusing section and the fusing section, wherein the separating section separates a portion or the entire nozzle from the fusing section.

The present application is based on Japanese Patent Application No. 2011-031567 filed on Feb. 17, 2011 to the Japanese Patent Office, which shall be a basis for correcting mistranslations.

What is claimed is:

1. A fusing apparatus for use in an image forming apparatus, the fusing apparatus comprises:

a fusing section including a nipping section which conveys a recording medium while applying pressure and heat to the recording medium;

an injecting section which is provided on a downstream side of a conveying direction of the recording medium with respect to the nipping section and which injects gas between a recording medium, which is conveyed by the nipping section, and the fusing section;

a detecting section which detects jamming of the recording medium in a conveying path of the recording medium and outputs a jamming detection signal, the detection section being between the injection section and the nipping section;

a control section receives the jamming detection signal from the detecting section and sends a control signal; and a separating assisting section receives the control signal and separates the injecting section from the fusing section when jamming of the recording medium is detected by the detecting section.

2. The fusing apparatus of claim 1, wherein, the separating assisting section separates the injecting section from the fusing section when the image forming apparatus is not forming an image on the recording medium.

3. The fusing apparatus of claim 1, further comprising:

a supporting member which supports the injecting section to enable movement along a predetermined movement path, wherein the separating assisting section moves the injecting section along the predetermined movement path to separate the injecting section from the fusing section.

4. The fusing apparatus of claim 3, wherein, the supporting member supports the injecting section to enable rotating motion; and the separating assisting section separates the injecting section from the fusing section by rotating motion of the injecting section.

5. The fusing apparatus of claim 3, wherein, the supporting member supports the injecting section to enable linear motion; and the separating assisting section separates the injecting section from the fusing section by linear motion of the injecting section.

6. The fusing apparatus of claim 1, further comprising:

a maintaining section which maintains the injecting section in a position where gas is injected between a recording medium, which is conveyed by the nipping section, and the fusing section; and a releasing section which releases the position of the injecting section maintained by the maintaining section when the detecting section detects jamming of the recording medium, wherein the separating assisting section separates the injecting section from the fusing section when the releasing section releases the position of the injecting section maintained by the maintaining section.

7. The fusing apparatus of claim 1, wherein, the injecting section includes:

a jet flow generating section which generates a jet flow of a gas; and a nozzle provided on a downstream side of a conveying direction of the recording medium with respect to the nipping section wherein the nozzle injects a jet flow of gas generated by the jet flow generating section between a recording medium conveyed by the nipping section and attached to the fusing section and the fusing section, wherein the separating assisting section separates a portion or the entire nozzle from the fusing section.

8. An image forming apparatus comprising:

a fusing section including a nipping section which conveys a recording medium while applying pressure and heat to the recording medium;

an injecting section which is provided on a downstream side of a conveying direction of the recording medium with respect to the nipping section and which injects gas between a recording medium, which is conveyed by the nipping section, and the fusing section;

a detecting section which detects jamming of the recording medium in a conveying path of the recording medium and outputs a jamming detection signal, the detection section being between the injection section and the nipping section;

a control section receives the jamming detection signal from the detecting section and sends a control signal; and a separating assisting section receives the control signal and separates the injecting section from the fusing section when jamming of the recording medium is detected by the detecting section.

9. The image forming apparatus of claim 8, wherein, the separating assisting section separates the injecting section from the fusing section when the image forming apparatus is not forming an image on the recording medium.

10. The image forming apparatus of claim 8, further comprising:

a supporting member which supports the injecting section to enable movement along a predetermined movement path, wherein the separating assisting section moves the injecting section along the predetermined movement path to separate the injecting section from the fusing section.

11. The image forming apparatus of claim 10, wherein, the supporting member supports the injecting section to enable rotating motion; and the separating assisting section separates the injecting section from the fusing section by rotating motion of the injecting section.

12. The image forming apparatus of claim 10, wherein, the supporting member supports the injecting section to enable linear motion; and the separating assisting section separates the injecting section from the fusing section by linear motion of the injecting section.

13. The image forming apparatus of claim 8, further comprising:

a maintaining section which maintains the injecting section in a position where gas is injected between a recording medium, which is conveyed by the nipping section, and the fusing section; and a releasing section which releases the position of the injecting section maintained by the maintaining section when the detecting section detects jamming of the recording medium, wherein the separating assisting section separates the injecting section from the fusing section when the releasing section releases the position of the injecting section maintained by the maintaining section.

14. The image forming apparatus of claim 8, wherein, the injecting section includes:

a jet flow generating section which generates a jet flow of a gas; and a nozzle provided on a downstream side of a conveying direction of the recording medium with respect to the nipping section wherein the nozzle injects a jet flow of gas generated by the jet flow generating section between a recording medium conveyed by the nipping section and attached to the fusing section and the fusing section, wherein the separating assisting section separates a portion or the entire nozzle from the fusing section.

* * * * *